US007409965B2

(12) United States Patent
Blaser et al.

(10) Patent No.: US 7,409,965 B2
(45) Date of Patent: Aug. 12, 2008

(54) DIRECT ACTING HYDRAULIC TRIP BLOCK

(75) Inventors: Samuel Blaser, Altendort (CH); Heinz Vogler, Uetilburg (CH)

(73) Assignee: Elliott Company, Jeannette, PA (US)

( * ) Notice: Subject to any disclaimer, the term of this patent is extended or adjusted under 35 U.S.C. 154(b) by 25 days.

(21) Appl. No.: 11/581,799

(22) Filed: Oct. 16, 2006

(65) Prior Publication Data

US 2008/0087339 A1 Apr. 17, 2008

(51) Int. Cl.
*F01D 21/18* (2006.01)

(52) U.S. Cl. ..... 137/613; 137/884; 137/553

(58) Field of Classification Search ..... 137/613, 137/884, 554, 553
See application file for complete search history.

(56) References Cited

U.S. PATENT DOCUMENTS

| | | | | |
|---|---|---|---|---|
| 3,429,180 | A | 2/1969 | Vind | |
| 3,754,565 | A * | 8/1973 | Gennetten | 137/384.4 |
| 3,834,484 | A * | 9/1974 | Sangster | 137/613 |
| 4,001,654 | A | 1/1977 | Davis et al. | |
| 4,215,844 | A | 8/1980 | Bowen | |
| 4,455,614 | A | 6/1984 | Martz et al. | |
| 4,524,796 | A * | 6/1985 | Ayers et al. | 137/613 |
| 4,621,496 | A | 11/1986 | Lamb | |
| 4,637,587 | A | 1/1987 | Kühnlein | |
| 5,143,119 | A | 9/1992 | Plangger | |
| 5,217,199 | A | 6/1993 | Frey | |
| 5,280,807 | A | 1/1994 | Frey et al. | |
| 5,561,976 | A | 10/1996 | Chu et al. | |
| 5,626,070 | A | 5/1997 | Sorbel | |
| 5,665,898 | A | 9/1997 | Smith et al. | |
| 6,155,282 | A | 12/2000 | Zachary et al. | |
| 6,435,202 | B2 | 8/2002 | Zachary et al. | |
| 6,478,048 | B2 | 11/2002 | Hays | |
| 6,722,383 | B2 | 4/2004 | Summers et al. | |
| 6,862,914 | B1 | 3/2005 | Zachary et al. | |
| 6,943,540 | B2 | 9/2005 | Vincent et al. | |
| 7,025,326 | B2 | 4/2006 | Lammert et al. | |
| 2003/0139837 | A1 | 7/2003 | Marr | |
| 2005/0242310 | A1 | 11/2005 | Takiguchi et al. | |

FOREIGN PATENT DOCUMENTS

| | | |
|---|---|---|
| DE | 30 40 367 A1 | 5/1982 |
| DE | 3040367 | 5/1982 |
| DE | 34 32 890 A1 | 1/1986 |
| EP | 0 433 791 A1 | 6/1991 |
| EP | 0 641 919 A1 | 3/1995 |
| JP | 11-006402 | 1/1999 |

* cited by examiner

*Primary Examiner*—Kevin L Lee
(74) *Attorney, Agent, or Firm*—The Webb Law Firm

(57) ABSTRACT

A direct acting hydraulic voting trip block defines three separate paths between an inlet and an outlet port. Each path is intersected by a valve cylinder. Valve pistons in each valve cylinder are configured, in the activated position, to block two of thee different paths. As long as at least two of the pistons are in the activated position, communication between the inlet and outlet ports is prevented.

9 Claims, 1 Drawing Sheet

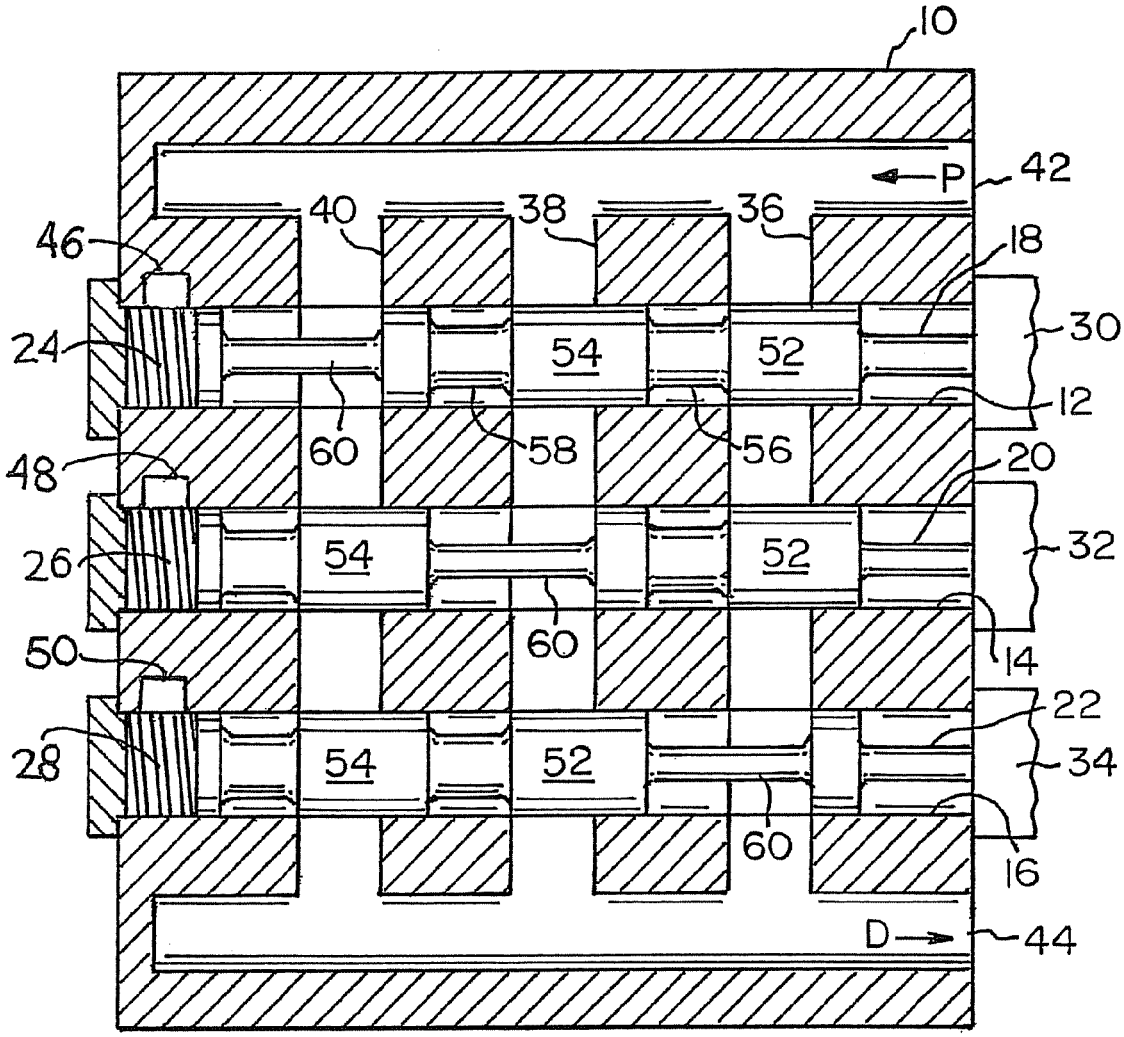
10
P
42
40
38
36
46
18
24
30
54
52
12
60
58
56
48
20
26
54
52
32
60
50
14
22
28
54
52
34
60
16
D
44

DIRECT ACTING HYDRAULIC TRIP BLOCK

BACKGROUND OF THE INVENTION

1. Field of the Invention

This invention relates to a direct action hydraulic trip block for steam turbines and other applications.

2. Description of Related Art

Apparatus for monitoring conditions and driving quick-closing valves by dumping control fluid wherein a majority determining switching logic is implemented are known, for example, from U.S. Pat. No. 4,637,587 entitled "Facility for the Monitoring of Physical Quantities on Systems."

SUMMARY OF THE INVENTION

It is an object of this invention to provide a hydraulic majority voting logic valve system in a single valve block.

Briefly, according to this invention, there is provided a direct acting hydraulic voting trip block comprising a valve block having three valve cylinders therein, three valve pistons in the valve cylinders, three springs for biasing the valve pistons in non-activated position, and three electric solenoid actuators for, in response to a non-fault signal, moving the piston against the bias of the springs into an activated position. The valve block defines three separate paths between an inlet port and an outlet port. Each path intersects the three valve cylinders. Each valve piston is configured to, in the activated position, block two of the three paths. Each valve piston is configured to close a different two of the three paths. Thus, as long as at least two of the pistons are in the activated position, communication between the inlet and outlet ports is prevented.

According to a preferred embodiment, the voting trip block is provided with three valve piston position monitors, one associated with each valve piston. Thus, a solenoid can be commanded to deactivate and the response of the corresponding position monitor observed to determine the associated solenoid, valve piston, and position monitor are in good running order without allowing communication between the inlet and outlet ports.

According to a preferred embodiment, each piston extends axially between a solenoid actuator and a bias spring and has two enlarged diameter blocking sections for closing two paths when in the activated position and two smaller diameter unblocking sections adjacent the blocking portion for opening the two paths and a third elongated unblocking section for unblocking the third path in either the activated or non-activated position.

BRIEF DESCRIPTION OF THE DRAWING

Further features and other objects and advantages will become clear from the following detailed description made with reference to the drawing which is a section view of one embodiment of a hydraulic voting trip block according to this invention.

DESCRIPTION OF THE PREFERRED EMBODIMENTS

Referring to the drawing, a direct acting hydraulic voting trip block comprises a valve block 10 having three valves 12, 14, 16 cylinders therein. Three valve pistons 18, 20, 22 are located in the valve cylinders. Three springs 24, 26, 28 bias the valve pistons in the non-activated position. Three electric solenoid actuators 30, 32, 34 are provided for moving the pistons against the bias of the springs into an activated position. Typically, the solenoid actuators move the piston into an activated position when receiving a non-fault condition signal. The valve block defines three separate paths 36, 38, 40 between an inlet port 42 and an outlet port 44. Each path intersects the three valve cylinders. Each valve piston is configured to, in the activated position, block two of the three paths. Each valve piston is configured to close a different two of the three paths. Thus, as long as at least two of the pistons are in the activated position, communication between the inlet and outlet ports is prevented. Normally, the inlet port is in communication with a normally pressurized control port.

The voting trip block is provided with three valve piston position monitors 46, 48, 50, one associated with each valve piston. Thus, a solenoid can be commanded to deactivate and the response of the corresponding position monitor observed to determine the associated solenoid, valve piston, and position monitor are in good running order without allowing communication between the inlet and outlet ports.

As shown in the drawing, each piston 18, 20, 22 extends axially between a solenoid actuator and a bias spring. Each piston has two enlarged diameter blocking sections 52, 54 for closing two paths when in the activated position and two smaller diameter unblocking sections 56, 58 adjacent the blocking portion for opening the two paths and a third elongated unblocking section 60 for unblocking the third path in either the activated or non-activated position.

As shown in the drawing of the preferred embodiment, the three valve cylinders have parallel and spaced axes. The three paths between the inlet and outlet ports have portions intersecting the valve cylinders which have parallel and spaced axes. The axes of the valve cylinders and the paths between the inlet and outlet ports are perpendicular. The bias springs and solenoids are at the opposite axial end of the valve cylinders. The solenoids are aligned on one face of the valve block.

Having thus defined our invention in the detail and particularity required by the Patent Laws, what is desired protected by Letters Patent is set forth in the following claims.

The invention claimed is:

1. A direct acting hydraulic voting trip block comprising:

a valve block having three valve cylinders therein;

three valve pistons in the valve cylinders;

three springs for biasing the valve pistons in non-activated position;

three electric solenoid actuators for in response to a non-fault signal moving the piston against the bias of the springs into an activated position;

said valve block defining three separate paths between an inlet port and an outlet port, each path intersecting the three valve cylinders;

each valve piston being configured to, in the activated position, obstruct two of the three paths and each valve piston being uniquely configured to obstruct a different two of the three paths;

whereby as long as at least two of the pistons are in the activated position communication between the inlet and outlet ports is prevented.

2. A direct acting hydraulic voting trip block according to claim 1, comprising three valve piston position monitors one associated with each valve piston whereby a solenoid can be commanded to deactivate and the response of the corresponding position monitor observed to determine the associated solenoid, valve piston, and position monitor are in good running order without allowing communication between the inlet and outlet ports.

3. A direct acting hydraulic voting trip block according to claim 1, wherein the three valve cylinders have parallel and spaced axes.

4. A direct acting hydraulic voting trip block according to claim 1 or 3, wherein the three paths between the inlet and outlet ports have portions intersecting the valve cylinders which have parallel and spaced axes.

5. A direct acting hydraulic voting trip block according to claim 4, wherein the axes of the valve cylinders and the paths between the inlet and outlet ports are perpendicular.

6. A direct acting hydraulic voting trip block according to claim 1, wherein the bias springs and solenoids are at the opposite axial ends of the valve cylinders.

7. A direct acting hydraulic voting trip block according to claim 1, wherein the solenoids are aligned on one face of the valve block.

8. A direct acting hydraulic voting trip block according to claim 1, wherein the inlet port is in communication with a normally pressurized control port.

9. A direct acting hydraulic voting trip block according to claim 1, wherein each piston extends axially between a solenoid actuator and a bias spring and has two enlarged diameter blocking sections for closing two paths when in the activated position and two smaller diameter unblocking section adjacent the blocking portion for opening the two paths and a third elongated unblocking section for unblocking the third path in either the activated or non-activated position.

* * * * *

UNITED STATES PATENT AND TRADEMARK OFFICE

CERTIFICATE OF CORRECTION

PATENT NO. : 7,409,965 B2
APPLICATION NO. : 11/581799
DATED : August 12, 2008
INVENTOR(S) : Blaser et al.

It is certified that error appears in the above-identified patent and that said Letters Patent is hereby corrected as shown below:

Face of the Patent, See Item (57) ABSTRACT, Line 5, "thee" should read -- the three --

Column 4, Line 9, Claim 9, "unblocking section" should read -- unblocking sections --

Signed and Sealed this

Thirtieth Day of December, 2008

JON W. DUDAS
*Director of the United States Patent and Trademark Office*